United States Patent [19]

Bannister

[11] Patent Number: 4,606,394

[45] Date of Patent: Aug. 19, 1986

[54] BARRIER SYSTEMS AND THE LIKE

[75] Inventor: Brian C. Bannister, North Mymms, England

[73] Assignee: Marler Haley Exposystems Ltd., Hertfordshire, England

[21] Appl. No.: 648,609

[22] Filed: Sep. 7, 1984

Related U.S. Application Data

[63] Continuation of Ser. No. 418,550, Sep. 15, 1982.

[30] Foreign Application Priority Data

Sep. 18, 1981 [GB] United Kingdom ..... 8128363

[51] Int. Cl.[4] ..... E04H 17/00

[52] U.S. Cl. ..... 160/351; 160/135; 52/738; 52/239

[58] Field of Search ..... 160/135, 351; 256/1, 256/DIG. 5, DIG. 6, 65, 24

[56] References Cited

U.S. PATENT DOCUMENTS

| | | | |
|---|---|---|---|
| 1,344,507 | 6/1920 | Hagstrom | 49/394 X |
| 1,661,003 | 2/1928 | Miller | 160/135 X |
| 2,855,037 | 10/1958 | Stiffel | 160/135 |
| 3,370,389 | 2/1968 | Macaluso | 52/239 |
| 3,841,042 | 10/1974 | Siegal | 52/282 |
| 3,987,838 | 10/1976 | La Gue | 160/135 |
| 4,038,790 | 8/1977 | Paisley | 52/281 |
| 4,101,231 | 7/1978 | Streib | 52/282 |

FOREIGN PATENT DOCUMENTS

| | | | |
|---|---|---|---|
| 2160513 | 6/1973 | Fed. Rep. of Germany | 52/282 |
| 2739364 | 3/1979 | Fed. Rep. of Germany | 52/282 |
| 1313182 | 11/1962 | France | 160/135 |
| 2102466 | 2/1983 | United Kingdom | 256/DIG. 5 |

*Primary Examiner*—Ramon S. Britts
*Assistant Examiner*—Cherney S. Lieberman
*Attorney, Agent, or Firm*—Parmelee, Miller, Welsh & Kratz

[57] ABSTRACT

A barrier or personnel guidance system is disclosed which utilizes vertical posts and horizontal rails each comprising an elongate central member formed, for example by a metal extrusion covered by cladding, formed for example by a plastics extrusion or extrusions, the central member and the cladding having complementary inter-engaging retaining formations. The central member comprises a central passage and lateral channels in which can be engaged various ancillary members whereby posts and rails can be interconnected, panels fitted, gate assemblies constructed and the like constructional facilities afforded.

11 Claims, 8 Drawing Figures

BARRIER SYSTEMS AND THE LIKE

This is a continuation of co-pending application Ser. No. 418,550 filed Sept. 15, 1982.

BACKGROUND OF THE INVENTION

This invention relates to a barrier, personnel guidance system or the like and to components for such a system.

It is frequently desired, in public access buildings such as airport buildings and the like, to provide barriers or personnel guidance arrangements which can be readily taken down and re-erected, or varied as to layout etc., and which are nevertheless of a robust and durable nature and of an aesthetically pleasing appearance. Such systems generally comprise a series of vertical posts, with the space between posts being spanned by a rail of some sort. The posts may be set in complementary sockets or holes provided permanently in the floor of the building concerned and concealed by appropriate cover plates when the posts are not fitted.

Prior systems of this kind have had various disadvantages, for example in being expensive to produce initially, being prone to rapid deterioration, being difficult to repair satisfactorily and lacking versatility.

SUMMARY OF THE INVENTION

It is among the objects of the present invention to provide an improved barrier or personnel guidance system in which the above noted disadvantages are reduced or eliminated, and to provide components for such a system.

According to one aspect of the invention there is provided a post for use in a barrier or personnel guidance system, the post comprising an elongate central member of substantially uniform cross section throughout its length, an elongate outer cladding member of substantially uniform cross section throughout its length, on the exterior of the central member, and means retaining the cladding member on the central member, said means including retention formation means provided on the periphery of the central member and complementary retention formation means provided on the inside of the cladding member and engaging in the retention formation means on the central member.

According to another aspect of the invention there is provided a gate arrangement for a barrier or personnel guidance system comprising a series of fixed vertical posts with adjacent posts being connected by horizontal rail members, the gate arrangement comprising a gate assembly interposed between a first said fixed vertical post and a second said fixed vertical post not otherwise connected with the first said fixed vertical post by a said horizontal rail member, said gate arrangement comprising;

a mobile vertical post disposed adjacent and parallel with said first fixed vertical post, pivot means pivotally connecting said mobile vertical post with said first fixed vertical post for pivoting about a vertical axis, and a barrier member extending from said mobile vertical post and movable therewith, said pivot means including an upper and a lower pivot plate each lying substantially in a respective horizontal plane and each having a first aperture therein receiving rotatably a respective end of the first fixed vertical post, and a second aperture therein receiving a respective end of the mobile vertical post, whereby said pivot plates are pivotable conjointly about the vertical axis of said first fixed post, and said mobile post is pivotable about its vertical axis in said pivot plates.

According to yet another aspect of the invention, there is provided a barrier or personnel guidance system, comprising a series of fixed vertical posts with horizontal rail members each spanning the gap between a respective pair of adjacent said posts, the system including a gate interposed between two adjacent vertical posts, said gate including a first mobile vertical post disposed adjacent a first said fixed post, and a second mobile vertical post disposed adjacent a second said fixed post, means pivotally connecting said first mobile post to said first fixed post for pivoting about a vertical axis, and cooperating latch means on said second mobile post and on said second fixed post for retaining said gate in a closed position in which said second mobile post adjoins said second fixed post, and wherein said second mobile post and said second fixed post are both members of a cross-section affording a longitudinally extending outwardly open channel, said second posts being arranged so that in the closed position of the gate said channel of the second mobile post opposes said channel of the second fixed post, said latch means including a latch member mounted in said channel of one of said second posts for projection into and withdrawal from said channel of the other of said posts, and manually operable means for moving said latch member.

DESCRIPTION OF THE PREFERRED EMBODIMENT

Figure 1:
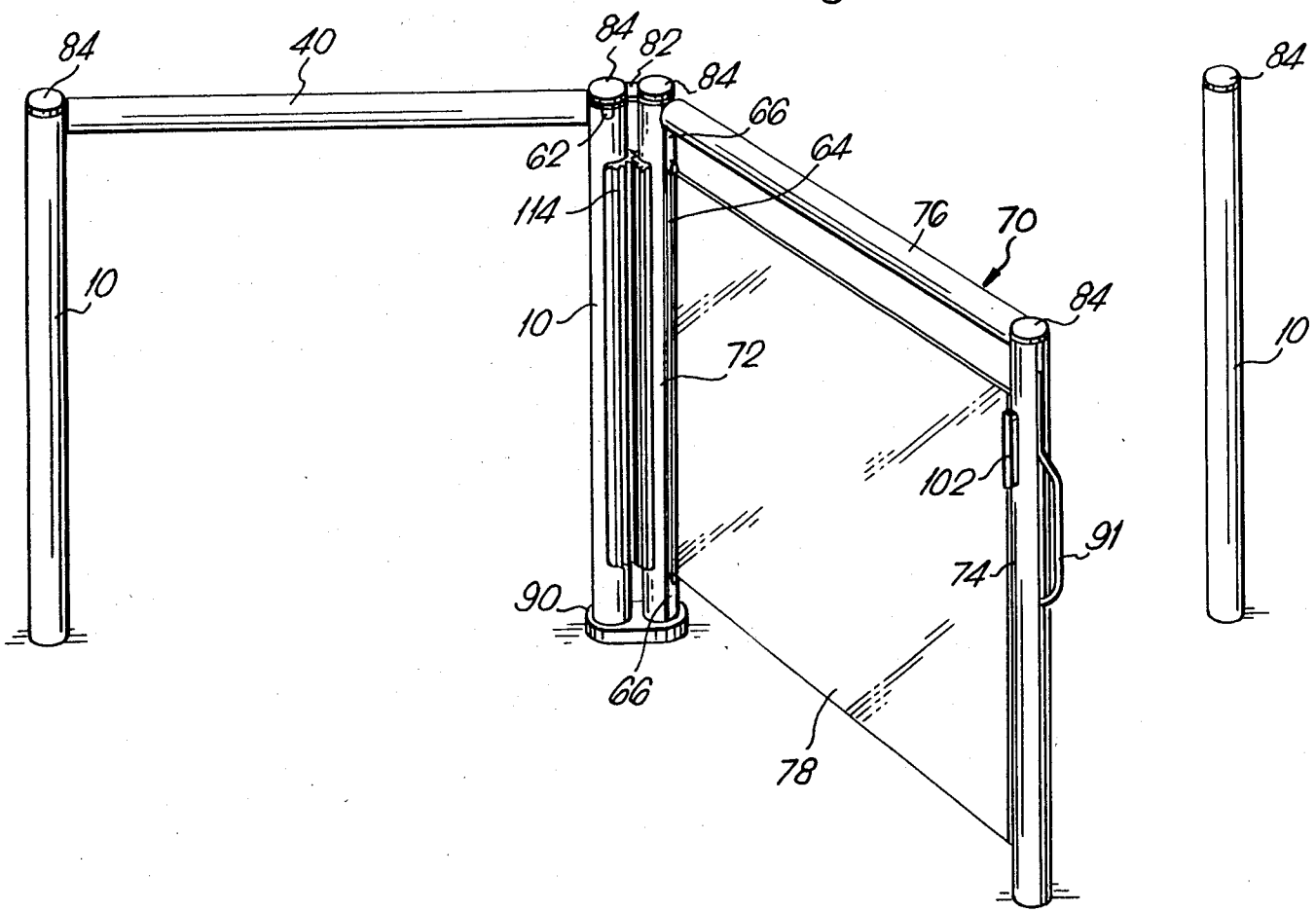
FIG. 1 is a diagrammatic perspective view of part of a barrier system embodying the invention.

Referring to the drawings, a barrier and pedestrian guidance system for a public access building comprises (see FIG. 1) a plurality of upright posts 10, of cylindrical overall shape which are fitted at their lower ends into holes or sockets provided in known manner in the floor of the building, said sockets terminating flush with the floor surface. The posts 10 are removably secured in the sockets and the sockets, when not occupied by posts 10, are occupied by suitable filling members or covered by cover plates.

Figure 3:
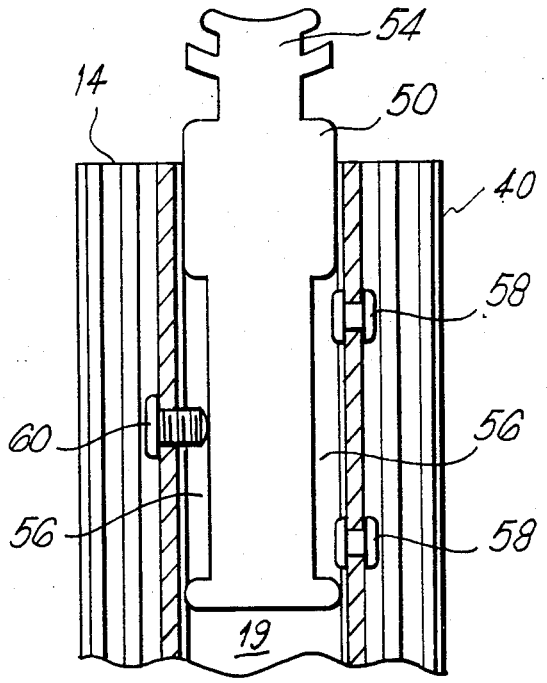
FIG. 3 is a view in longitudinal section of an end part of a rail forming part of the system of FIG. 1, FIGS. 4 and 5 are perspective views, FIG. 4 being an exploded view, showing the pivotal mounting of a gate post in the system of FIG. 1.

Each post 10 incorporates a central member 14 in the form of an aluminium extrusion, of the constant cross section shown and which corresponds to a cylinder with four major longitudinal channels 16 arranged at intervals of 90° around the central axis of the cylinder and opening on to the periphery thereof, four minor longitudinal channels 18 opening onto the periphery of the cylinder and each disposed midway between a respective pair of adjoining major channels 16, and a central through passage 19 having four right-angled V-section corner portions 20 disposed in the same diametral planes as the minor channels 18 and each having each of its side walls coplanar with a respective side wall of a respective adjacent V-section channel the central passage 19 having the portions disposed between these corner portions 20 formed as respective part-cylindrical coaxial portions. The central passage 19 is thus suitably configured to receive snugly either a cylindrical axial member or a square-section axial member of the appropriate sizes. Thus, as will be appreciated hereinafter, the central passage 19 can receive either the cylindrical tie bolt 102 of FIG. 7 or the square, cross-rail attachment insert 50 of FIG. 3.

Each post 10 is normally provided, on the external arcuate surfaces thereof, with plastics cladding 24, which may, if none of the channels 16 are to be utilised, take the form of a completely cylindrical thin-walled plastics tube formed internally at intervals of 90° therearound, with longitudinally extending, T-section ribs 26 which engage in and are retained in the channels 18. It will be noted that each channel 18 opens onto the circumference of member 14 in a narrow slot, (which receives the stem of the T-section) and has, disposed radially inwardly of said slot, a transversely wider region in which the cross piece of the "T" is received. The radially innermost part 101 of each channel 18 is part-cylindrical, having, in cross-section, the form of an arc of substantially more than 180°. The part 101 serves, when required, to receive longitudinally driven self-tapping screws 103' to retain end plates 103 or the like, when used, on the end of such a central member 14, see FIG. 7.

Figure 2:
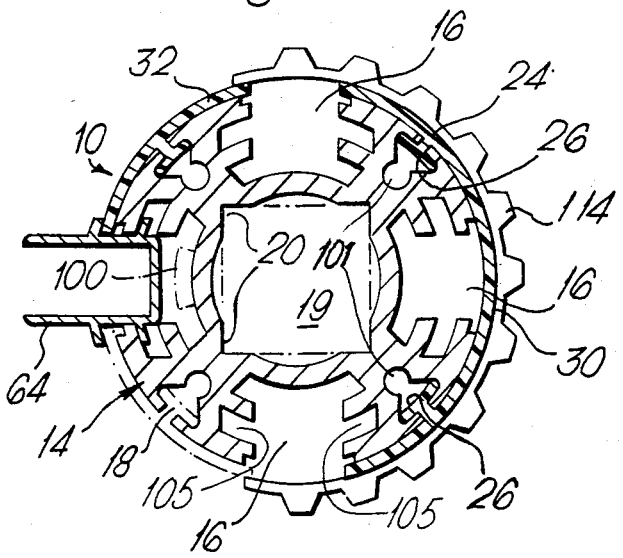
FIG. 2 is a view in cross section of a post forming part of the system of FIG. 1.

As will become apparent, it is frequently necessary for one or more of the channels 16 of a member 14 to be exposed to the exterior, and in such cases use may be made of a second form of cladding element corresponding in form to the aforesaid completely cylindrical cladding element with one of the regions which would extend over a channel 16 removed, or of a third form of cladding element corresponding in form to the first form of cladding element with the region extending over the arcuate surface of member 14 on either side of a channel 18 and over the adjoining channels 16 removed, or a fourth form of cladding element, one of which is shown at 30 in FIG. 2 corresponding to the portion of the first form of cladding element extending over the arcuate surface portions of the member 14 on either side of two adjoining channels 18 and over the intervening channel 16, or of a fifth form of cladding element, indicated at 32 in FIG. 2, which simply extends over the two arcuate surface portions of the member 14 on either side of a single channel 18 and ending substantially at the adjoining edges of the channel 16 on either side.

Figure 7:
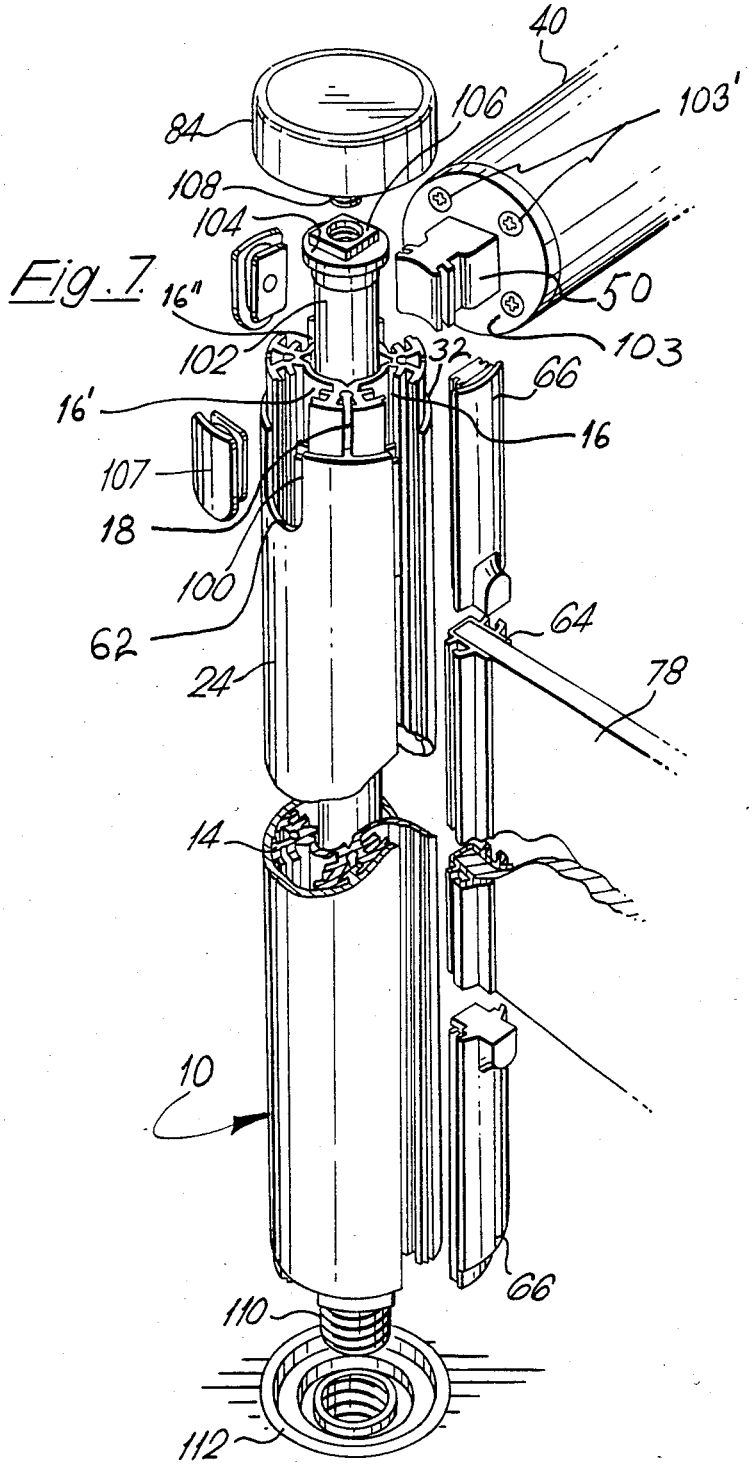
FIG. 7 is an exploded, partial perspective view showing part of the barrier system.

As can be seen in FIGS. 2 and 7, the post 10 is capable of selectively receiving one, two, three or four cross-rails 40 and/or panel-receiving members 64 in its four circumferentially spaced first channels 16. The configuration and number of the cladding elements to be utilized would depend upon the number of panels or cross-rails to be used and the layout for a particular post 10. For example, if two cross-rails 40 or panels 78 were employed and positioned directly in line, on opposite sides of the post 10, then two of the cladding elements 30 of FIG. 2 would be employed on the post 10 in order to cover the two unoccupied first channels 16. In the event a cross-rail 40 and a panel 78 are aligned in adjacent first channels 16 in a right angle layout as shown in FIG. 7, the 90° arc cladding element 32 would be employed between the two cross-members 40 and 78. A continuous cladding element 24 extends around the remaining 270° arc of the post 10 covering the two unoccupied first channels 16' and 16''.

While the arcuate outer surfaces of the member 14 may be smooth, it has been found advantageous to form the out surfaces of member 14 with small projections (not shown) at intervals, for example with a plurality of longitudinal ribs of small cross section such projections have been found to reduce the frictional forces arising when a cladding element is slid longitudinally over the member 14 during assembly.

As shown in FIG. 1, in the system illustrated, adjacent posts 10 are interconnected by rails 40 each extending from the upper end of one post 10 to the upper end of the adjacent post 10. The rails 40 are preferably formed of lengths of the same extrusion as that indicated at 14 in FIG. 2, similarly fitted with a cladding element, generally a completely cylindrical cladding element of the same kind as described above.

Each rail member 40 is connected with the post 10 between which it extends by means of an insert 50 (FIG. 3) which includes a shank portion parts of which are of square cross section such that the shank portion is a free sliding fit in the passage 19 with the corner portions 20 of the passage receiving and guiding the corresponding corner portions of the square section part of the shank 50. The insert 50 also has a head portion 54 with a shape, in longitudinal horizontal section, which is complementary with the cross sectional shape of one of the major channels 16, so that the head portion 54 can be slid longitudinally into one of the channels 16 from one end of the member 14 of a post 10 to be reliably and securely retained in said channel. The insert 50 is preferably formed as a transverse "slice" cut from an aluminium extrusion of the cross sectional shape shown in FIG. 3, so that, with reference to the orientation adopted when the rail 40 is in position, the insert 50 has planar upper and lower faces which are spaced apart by a distance corresponding to the spacing between the vertical flank walls of the insert 50 which are afforded by the longitudinally extending flanks of the extrusion. The shank of the insert 50 is preferably formed with recesses 56, (defined by longitudinal grooves in the original extrusion) into which extend stop members, in the form of rivets 58 extending through the wall of the passage 19 from one of the channels 16 of the extrusion 14 of the rail 40, so that the insert 50 is retained captive in the end of the rail 40 but can move axially relative to the rail 40 to a limited extent, as is necessary to take up tolerances in the placing of the posts 10, as seen FIG. 3. A set screw 60 may likewise be provided whereby the insert 50 can be clamped in position relative to the rail 40. Indicated at in FIG. 7 is an end cap 103, for example of plastics, in the form of a flat circular disc of the same diameter as the clad rail 40, the end cap being fixed to the rail by screws 103' screwed into the channel portions 101 at the end of the rail member, the end cap having a central, square opening through which the shank of the insert 50 extends.

As indicated in FIG. 1 and FIG. 7, the cladding member, or the appropriate one of the cladding members of a post 10 is provided with a notch 62 extending from the upper edge of the cladding member and in register with a respective main channel 16, and each insert 50 extends through such a notch 62 to engage in the central member 14 of the respective post 10. The insert member 50 bears upon, and is supported by a rail support 100, in the form of a curved support plate received in the base portion of the respective channel 16 and secured, e.g. by screws (not shown) to the bottom of the channel. The upper end of the rail support 100 preferably has bonded thereto a rubber buffer which receives the insert 50 and serves to absorb dimensional tolerances. Those notches 62 of the cladding not required in any particular layout are covered by cover plates 107, for example of plastics each having a facing portion which overlies the cladding around the notch, a neck portion which extends through the notch and carries a retaining plate the edges of which are lodged in the side channels 105 of the channel 16. The system also allows the spaces between adjacent posts beneath the rail 40 to be infilled if desired, by a suitable panel or a glass or plastics pane or the like. To this end, in each pair of adjacent posts 10 between which such a panel is to be fitted, the main channels 16 of the two posts 10 which face towards one another are fitted with respective panel-receiving u-shaped, channel members 64 in the form of lengths of extruded plastics material of the cross section shown in FIG. 2, affording a channel to receive the edge of the respective panel, pane or the like, with a pair of longitudinally extending ribs on the outer side of each side wall of the channel defining, between each said pair or ribs, a groove to receive a respective peripheral flange portion of the extrusion 14 and the superimposed longitudinal edge of the respective cladding member. After the members 64 have been slid longitudinally into place the respective pane is slid into the channels provided by the members 64 prior to fitting of the respective rail 40. Finishing inserts, 66 depicted in FIG. 7, for example of plastics material, may be provided, for example of a cross section to allow such inserts to be slidingly retained in a channel 16 and to present an outer face extending across the mouth of the channel 16 flush with the outer surface of the respective cladding element.

Such finishing inserts may, for example, be utilised, in applications such as that indicated at 66 between the upper end of a strip 64 serving to mount a panel or pane which stops short of the upper or lower end of the respective posts.

As shown in FIG. 7, each vertical post 10 is secured to the floor by means of a central tie bolt 102 which extends through the central passage 19 and has its lower end externally screw-threaded, as indicated at 110 for engagement in a correspondingly internally screw-threaded bore provided centrally in a base 112 fixedly installed in the floor, flush therewith, the base 112 having a shallow socket to receive the lower end of the central member 14. At its upper end, the tie bolt 102 has a radially outwardly extending collar 104 which, when the tie bolt is fully screwed home into the bore in base 112 bears upon the portions of the central member which bound the central passage 19 to clamp the central member axially. Above the collar 104, the tie bolt 102 has a square head 106 for engagement by an appropriate spanner. An axial bore extending from the upper end of the tie bolt is internally screw-threaded to receive a correspondingly threaded bolt 108 extending centrally from the underside of the cap 84 so that the cap 84 may be screwed down onto the insert(s) 50 and the top face of the central member, to clamp the insert(s) 50 firmly in place. The cap 84 is preferably screwed down using a strap-wrench so that it cannot be undone by hand alone.

The barrier system may also incorporate movable sections or gates which are pivotable relatively to the other parts of the system, for example to allow limited passage through a barrier or to divert pedestrian traffic flow etc. As shown in FIG. 1, such a section or gate 70 comprises, in much the same way as a fixed section of the barrier, two upright posts, indicated at 72 and 74, of substantially the same form as the posts 10, spanned by a rail member 76 of substantially the same form as the rail members 40. A panel or pane 78 supported in the posts 72 and 74 by panel receiving strips 64 in the manner described above serves to brace the posts 72, 74 and rail 76 relative to one another. The post 72 is pivotally connected with an adjoining fixed post 10, for pivoting either about the longitudinal axis of the post 72 or about the longitudinal axis of the adjoining post 10 or about both such axes, as explained below, by means shown to a larger scale in FIGS. 4 and 5. Thus, the central member 14 of the post 72 and the adjoining fixed post 10, at the upper ends of these posts, may be arranged to project from of the plastics cladding 24 to a predetermined axial extent, and the projecting end portions of the members 14 to engage in respective openings in a spectacle-shaped plate 82, for example of metal. The plates 82 may then be held in place on the tops of the posts 72 and 10 by the respective caps 84 with which these posts are provided. With such an arrangement, the member 14 of either the post 10 or the post 72, together with the attached cap 84 is free to turn about its vertical axis within the member 82, or the members 14 of both posts 10 and 72 may be free to turn in this fashion about their respective vertical axes. The posts 10 and 72 may be pivotally connected at their lower ends in an entirely analogous fashion by an identical member 82 so that the gate 70 is pivotally supported from the post 10. The pivotal mounting at the lower ends of the posts 10, 72 is preferably arranged to support also the weight of the gate 70, and in this case a slightly modified pivotal connection between the posts 10 and 72 may be provided at the lower ends of these posts, for example by means of a member 90 which is of increased depth as compared with the member 82 and may be of plastics material. The member 90 may also differ from the member 82 for example, in that the opening which receives the lower end of the post 72 does not, as in the case of the member 82, extend entirely through the member 90, but is formed as a blind bore to provide an upwardly facing thrust bearing for the post 72. The fragmentary perspective view of FIG. 5 shows the upper and lower ends of the gate coupling arrangement in the assembled condition.

In the preferred arrangement, the part of the member 90 directly below the post 72 carries, on its underside, a wheel (not shown) rotatable about a horizontal axis intersecting the pivotal axis of member 90 with respect to post 10, said wheel bearing on the floor surface, and supporting the respective part of member 90, (and thus the post 72 etc.) so that the respective part of member 90 is held slightly off the floor surface. A similar wheel may be provided at the lower end of the post 74, to roll over the floor, and support the post 74, during opening and closing movements of the gate.

Figure 4:
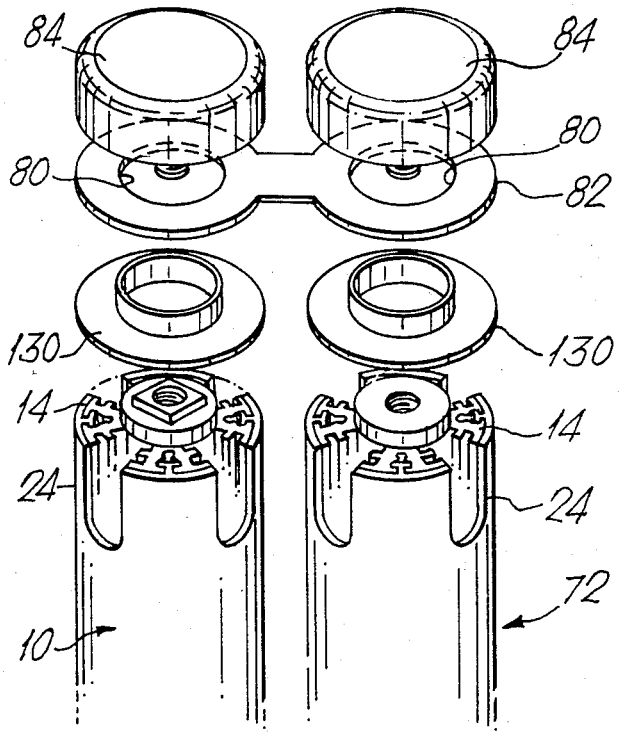
Figure 5:
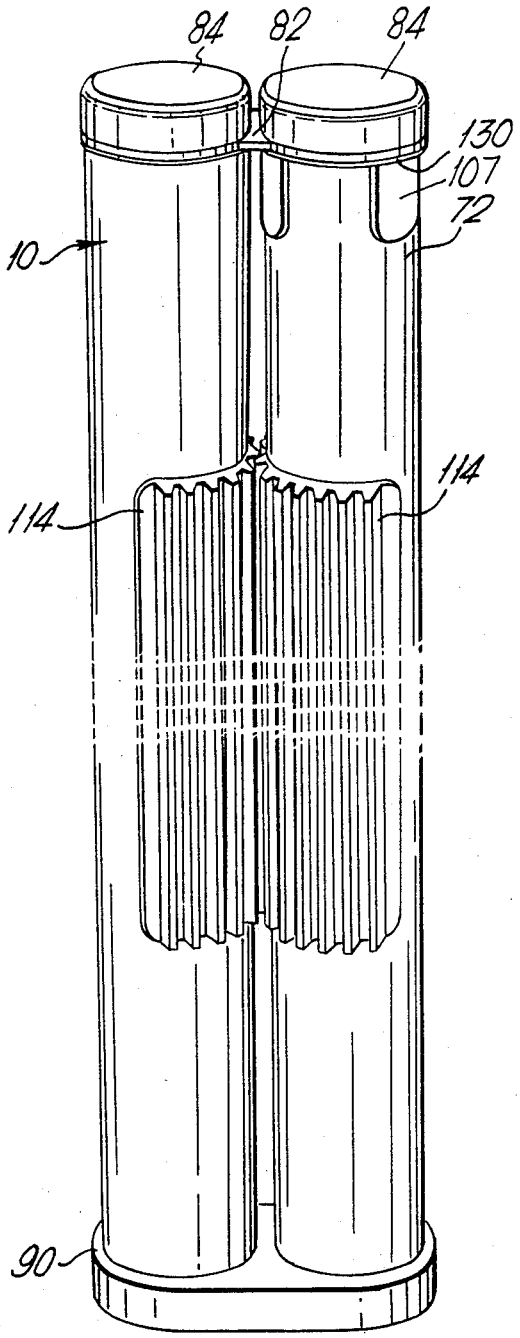

In the preferred embodiment of the invention, as shown in FIGS. 4 and 5, the apertures in the plate 82 are smaller in diameter than the central members 14, and receive rotatably respective short cylindrical tubular collars upstanding from the inner edges of respective annular bearing plates 130. Each plate 130 rests on the upper end face of the respective central member (at which the cladding terminates flush with the respective end face), and the tubular collar of each bearing plate receives internally a bearing formed by an annular rib projecting downwardly from the underside of the respective end cap 84. The end caps 84, are each provided with a respective downwardly extending screw threaded bolt for securing the end cap to the respective post.

In the case of the end cap 84 of the fixed post 10 the respective screw-threaded bolt 108 is screwed into the tie bolt 102, whereas in the case of the end cap 84 of the post 72, the respective screw-threaded bolt is screwed into an insert fixed in the central passage 19 of the central member, at its upper end, and having a screw-threaded bore to receive the bolt.

Instead of the whole lower end of the post 72 being rotatably received in a blind bore in the member 90, the post 72 may have, at its lower end, an insert fitted in the central passage 19 in the central member and having a downwardly projecting portion thereof formed as a cylindrical journal to fit rotatably in a complementary blind bore formed in the member 90, to afford a radial bearing for the post, whilst an annular plate, forming a thrust bearing, may be fixed to the lower end of post 72 to bear upon the upper surface of member 90: (not shown).

The arrangement shown in FIGS. 4 and 5 permits pivotal movement of the member 82 relative to the post 10 as well as relative to the post 72. Whilst such an arrangement may be convenient in certain situations, if desired, it may be arranged that the member 82 and the corresponding member 90 is fixed with respect to one of the posts 10 or 72, for example by being formed with a formation engaging in one of the channels of the respective central member 14.

In the arrangement shown in the drawings the post 10 and the post 72 are each provided with externally presented gear teeth, the arrangement being such that the gear teeth on the post 10 engage with those on the post 72, so that the post 72 can roll around the post 10 in geared engagement therewith, permitting, for example, the gate 70 to be swung back flat against the adjoining fixed section of the barrier on either side. The gear teeth on the posts 10 and 72 are preferably provided by respective lengths of an arcuate-section extrusion, such as indicated at 114 in FIG. 2, said lengths being adhesively bonded to the respective posts, the extrusion having a part cylindrical internal surface for engagement with the respective cladding member and a serrated or corrugated outer surface providing the gear teeth. If preferred, the gear teeth may be formed directly on the cladding members.

Figure 6:
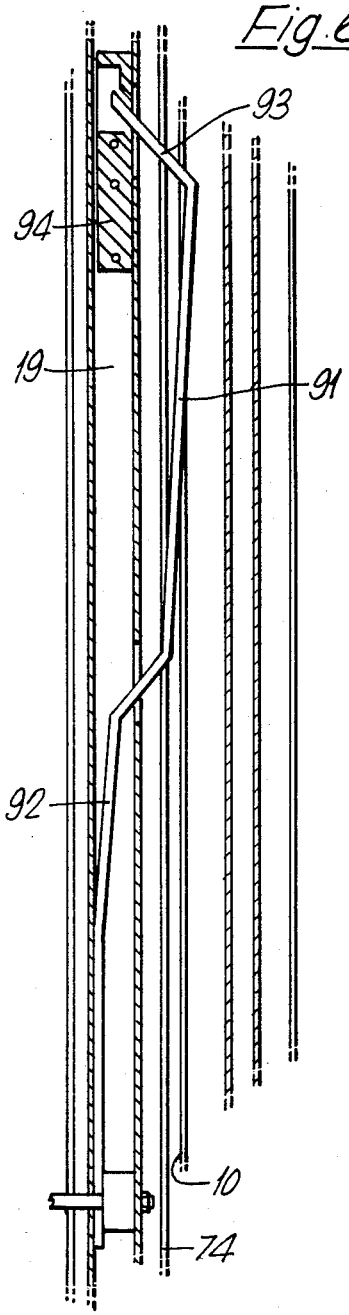
FIG. 6 is a view in axial section of part of a gate post member incorporating a latch.

The gate 70 is shown as being provided with a latch arrangement comprising a bar 91 of the form shown in FIG. 1 and to a larger scale in FIG. 6, which bar is received at its upper and lower ends in that major channel 16 of the post 74 which faces away from the post 72, the bar 91 lying within the radially and axially extending plane of that channel 16. More specifically, the bar 91 includes a lower vertical portion lying within the respective channel 16 and connected, at its lower end, via an outwardly sloping portion with an upper, vertically extending portion which normally lies radially outwardly of the respective channel 16 and which carries at its lower end an inwardly sloping portion which passes, through an aperture cut in the bottom well of the respective channel 16, into the central passage 19 of the central member of the post 74 where it is connected with a generally vertically extending portion 92, accommodated within the last-mentioned passage 19 and secured to the central member at its lower end. The portion 92 acts as a spring urging the upper vertically extending portion towards its outwardly projected position. An inwardly sloping portion 93 extends from the upper end of the upper vertically extending portion, through an aperture in the bottom wall of the channel 16, and into a sloping passage formed through a slider 94 slidable vertically within the central passage 19 in post 74 by means of an operating handle 102 connected to the slider 94 by means of bolts extended through a slot formed in the bottom wall of channel 16 perpendicular to that receiving the member 91. When the gate 70 is closed, the radially outer portion of the bar 91 extends into the opposing open channel of the stationary post 10 which directly adjoins the post 74 when the gate is closed, the last mentioned channel 16 being, for this purpose, left exposed by adopting an appropriate cladding arrangement. When the slider 94 is slid downwardly, the camming action of the wall of the inclined passage on the inclined portion 93 moves the upper vertically extending portion inwardly out of the channel 16 of the adjoining stationary post 10. The bottom wall of the channel 16 of post 74 diametrically opposed to that accommodating the upper vertical portion of bar 91 is also formed with an aperture through which the free end of portion 93 can pass in the fully retracted position of the bar.

The above description of the latch mechanism and its mode of operation omits, for the sake of simplicity, mention of the cladding etc. arrangements associated with the respective posts. In practice, the channel 16 in the stationary post 10 which receives the projected portion of the bar 91 is furnished with an appropriate plastics channel member similar to the member 64 of FIG. 2, but having only one side wall extending outwardly from the cladding-engaging flange, to act as a stop for bar 91, and having the cladding-engaging flange of the other side wall extended further over the surface of the cladding 24 to provide a striker surface for bar 91, while the opposing channel in post 74 is furnished with a plastics channel member similar to member 64 but so arranged that in the closed position of the gate the outwardly extending side walls of the two channel members lie on opposite sides of the bar 91. The channel member on the post 74 is also, of course, formed with apertures through which the inclined portions of bar 91 pass.

Figure 8:
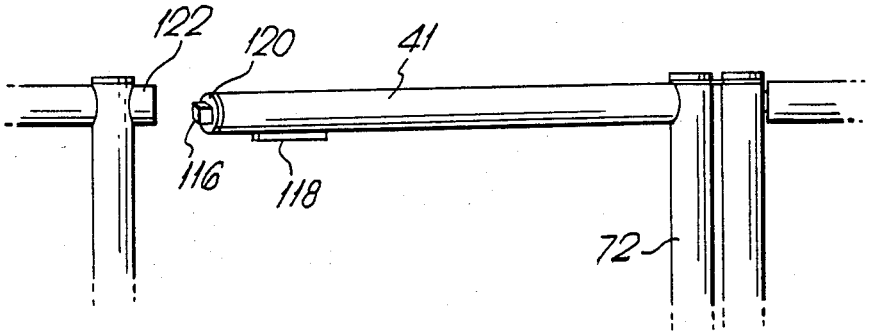
FIG. 8 is a perspective view of an alternative gate arrangement for the barrier system.

In a modified gate arrangement, shown in FIG. 8, the post 74 and panel 78 are omitted, and the free end of the horizontal rail 41, secured at its other end to post 74 is provided with a simple sliding bolt 116, accommodated in the central passage 19 of the rail and manually operable by a handle 118 connected with the sliding bolt by bolts, (not shown) extending through a slot, (not shown) in the rail 41. The bolt 116 also extends through a square aperture in an end plate 103 secured by screws to the central member in the manner described above. In the closed position of the gate of FIG. 8, the sliding bolt 116 is engaged in a complementary recess formed in a member 122 secured to the upper end of the fixed post 10 which the free end of the gate rail 41 opposes in said closed position of the gate.

The system described with reference to the drawings has various advantages over known systems intended for the same general purposes.

Thus, because the central members, cladding, inserts, etc., are formed as extrusions they can be produced relatively inexpensively and with little labour, it being necessary merely to cut the extrusions to the appropriate lengths. The metal central members afford adequate strength while the plastic cladding has excellent wearing properties and if it should become damaged, is readily replaced without replacing the central member etc. Furthermore because of the wide number of ways in which the components can be assembled together, the system is extremely versatile. The detachable plastics cladding can be made in any desired colour, and the ready interchangeability of the cladding makes it easy to change the colours of the posts and rails as desired, without undue expense, for example in the interests of decor or to implement colour coded routing schemes etc.

I claim:

1. A barrier system comprising:

a plurality of fixed vertical posts, each of said posts including an elongate central member of substantially uniform cross-section throughout its length and having a plurality of circumferentially spaced, first and second channels longitudinally extending along the outer periphery of said central member;

interconnecting means, including at least one horizontal rail member, extending between adjacent posts, said interconnecting means having opposed end portions carrying attachment means thereon for insertion into portions of the first channels in said central members to rigidly secure said interconnecting means thereto;

cladding means carrying longitudinally extending ribbed portions for insertion within the second channels of the central member, said cladding means covering the outer periphery of the central member and substantially all portions of said first channels which are unoccupied by the inserted attachment means carried by said interconnecting means, said cladding means also having a plurality of notched-out portions, circumferentially spaced at one end thereof, said notched-out portions overlying portions of each of said first channels around the central member to permit the selective placement of a horizontal rail member through at least one of said notched-out portions, and further including cover plate means to cover the unoccupied notched-out portions.

2. The barrier system of claim 1 including gate means disposed between two of said fixed vertical posts.

3. The barrier system of claim 2 wherein the gate means comprises:

a mobile vertical post disposed adjacent and parallel with one of said first fixed posts;

pivot means pivotally connecting said mobile vertical post with said first fixed vertical post for pivoting about a vertical axis;

a barrier member extending from said mobile vertical post and movable therewith, said barrier member extending to a second fixed vertical post when in a closed position; and cooperating latch means on said barrier member and on said second fixed vertical post for retaining said gate in the closed position.

4. The barrier system of claim 3 wherein said pivot means of the gate comprised an upper and lower pivot plate each lying substantially in a respective horizontal plane and each having a first aperture therein receiving rotatably a respective end of the first fixed vertical post, and a second aperature therein receiving a respective end of the mobile vertical post, whereby said pivot plates are pivotable conjointly about the vertical axis of said first fixed post, and said mobile post is pivotable about its vertical axis in said pivot plates.

5. The barrier system of claim 4 wherein said first fixed post and said mobile post carry respective intermeshing gear members whereby the pivotal movements of the first fixed and mobile posts, relative to said pivot plates, are maintained equal during opening and closing movements of the gate assembly.

6. The barrier system of claim 5 wherein said gear members are formed by respective part-cylindrical shells fixed to the exteriors of said first fixed post and said mobile post.

7. A barrier system comprising:

a plurality of fixed vertical posts, each of said posts including an elongate central member of substantially uniform cross-section throughout the length of the post, said central member having a plurality of circumferentially spaced, first and second channels longitudinally extending along the outer periphery thereof;

interconnecting means including at least one horizontal rail member extending between adjacent posts, said interconnecting means having opposed end portions carrying ribbed attachment means thereon for insertion into interengaging portions of the first channels in said central portions to rigidly secure said interconnecting means thereto;

cladding means carrying longitudinally extending ribbed portions for insertion within the second channels of the central member, said cladding means covering the outer periphery of the central member and substantially all portions of said first channels which are unoccupied by the inserted attachment means carried by said interconnecting means;

each horizontal rail member comprising a central member and cladding means which are substantially identical to those of the fixed vertical posts, and wherein the central members of said fixed vertical posts and the central members of said horizontal rail members each have a central through passage formed therein, each of said posts including a tie bolt fitted within the central passage of the central member of each post, each of said tie bolts adapted to be rigidly secured to floor mounted base means, and wherein the attachment means carried by the horizontal rail member includes an insert fitted within the central through passage at opposed ends thereof, each of said inserts including a head portion extending outwardly from the ends of the rail member for insertion into a first channel of an adjacent post and including a shank portion integral with said head portion and adjustably postioned within said central through passage to permit axial adjustment of said inserts relative to the rail member, whereby a variation in spacing between adjacent posts may be accommodated.

8. The barrier system of claim 7 wherein the interconnecting means includes at least one panel member.

9. The barrier system of claim 7 wherein the cladding means covering the posts has a plurality of notched-out portions, circumferentially spaced at one end thereof, said notched-out portions overlaying portions of each of said first channels around the central member to permit the selective placement of a horizontal rail member through at least one of said notched-out portions to engage a first channel, and further including cover plate means to cover the unoccupied notched-out portions.

10. The barrier system of claim 9 wherein the interconnecting means includes at least one panel member.

11. The barrier system of claim 7 including gate means disposed between two of said fixed vertical posts.

* * * * *